US005546881A

United States Patent [19]

Frederiksen

[11] Patent Number: 5,546,881

[45] Date of Patent: Aug. 20, 1996

[54] TRACK SYSTEM TO BE FASTENED TO A GROOVE IN A SPAR

[76] Inventor: Gert H. Frederiksen, 187, Ibækvej, DK-7100, Vejle, Denmark

[21] Appl. No.: 351,301

[22] PCT Filed: Jun. 12, 1992

[86] PCT No.: PCT/DK92/00182

§ 371 Date: Dec. 9, 1994

§ 102(e) Date: Dec. 9, 1994

[87] PCT Pub. No.: WO93/25436

PCT Pub. Date: Dec. 23, 1993

[51] Int. Cl.[6] ..... B63H 9/08

[52] U.S. Cl. ..... 114/112; 114/204

[58] Field of Search ..... 114/90, 112, 113, 114/204, 108, 102

[56] References Cited

U.S. PATENT DOCUMENTS 5,044,294 9/1991 Kronich et al. ..... 114/112

FOREIGN PATENT DOCUMENTS 9325436 12/1993 WIPO ..... 114/112

*Primary Examiner*—Sherman Basinger

*Attorney, Agent, or Firm*—Rothwell, Figg, Ernst & Kurz

[57] ABSTRACT

A track system for fastening at the groove (2) of a mast (1) includes a profiled track (4) and a plurality of slide members (5). The track (4) is formed to receive cars (12) in an axially slidable manner and is provided with transverse openings (17) for receiving the screws (38). The slide members (5) are adapted to be slidably arranged, however, the sliders are prevented from rotating in the groove (2) via a base (28) being engaged in the interior of the groove in the mounted state of the slide members (5) and a shaft extending through the slot (3) of the groove. The slide members include a threaded hole (36) adapted to coact with the thread (37) of a screw (38) when the thread has been inserted through the corresponding transverse opening (17) in the track (4) for fastening the track (4) to the mast (1). On the surface (34) adapted to face the groove (2) the track is provided with recesses (22) coaxially arranged with the transverse openings (17). The recesses (22) are adapted and dimensioned for receiving the protruding portion (33) of the slide members (5) in a circumscribing manner.

9 Claims, 4 Drawing Sheets

TRACK SYSTEM TO BE FASTENED TO A GROOVE IN A SPAR

TECHNICAL FIELD

The invention relates to a track system to be fastened to a groove in a spar, preferably in the groove on the back of a mast, comprising a track formed to receive cars in an axially slidable manner and provided with tranverse openings for receiving fastening means and a plurality of slide members adapted to be slidably arranged, however, prevented from rotating in the groove and having a base being engaged in the interior of the groove in the mounted state of the slide member, and a shaft extending through the slot of the groove and being provided with an axial opening adapted to coact with the fastening means inserted through the corresponding transverse opening in the track.

BACKGROUND ART

A track system is known, wherein the track is essentially U-shaped and adapted for mounting on the mast with the cavity facing the groove. The fastening means are screws being inserted through transverse openings in the track. For fastening the track onto the mast, each individual slide member is to be slid in the groove, until its threaded hole is aligned with the corresponding transverse opening in the track, whereafter a screw is inserted through the transverse opening to engage the threaded hole in the slide member. This is a rather difficult and time-consuming operation, and it is particularly difficult to bring the screw into engagement with the threaded hole. Further, said system has the drawback that the slide member slides downwards, until it abuts the subjacent slide member, if a screw is unscrewed after the track has been mounted. It is not possible to mount this slide member again without loosening all of the remaining slide members which have been used to fasten the track to the mast. This operation is often very time-consuming, since 200 slide members are sometimes used.

SUMMARY OF THE INVENTION

The object of the invention is to provide a track system of above type which is easier to mount on a spar having a groove than the hitherto known track systems.

In order to obtain the above object the track system according to the invention is characterised in that it is provided with recesses arranged coaxially with the transverse openings on the side intended to face the groove, and that said recesses are adapted and dimensioned for receiving the protruding portion of the shaft of said slide members in a circumscribing manner. As a result, the recesses act to position the slide members in such a manner that the axial opening thereof is essentially coaxial with the transverse opening of the track, when the protruding portion of the slide member is engaged in the corresponding recess, whereby the axial opening is easily caught by the fastening means, which according to a preferred embodiment of the invention is a screw, the axial openings in the slide members thus being threaded holes.

When mounting the tracks on a upright mast, the number of slide members corresponding to the number of transverse openings in the track are arranged in the groove, and a fastening means, such as a screw, is inserted through the lowermost transverse opening to engage the axial opening in the lowermost slide member. The row of slide members are then moved upwards by means of a tool, for instance a screwdriver inserted in between the track and the mast.

When the lowermost slide member is aligned with the second lowermost opening, the outermost end of the protruding portion of the slide member falls into the recess in the track, when the track is slightly preloaded towards the mast. The preload may be provided by pressing lightly against the track with the hand or by tightening the lowermost screw. This procedure is continued in an upward direction, until all of the slide members engage the corresponding transverse openings in the track. For every fourth to eighth slide member, it may be advantageous to fasten a screw in order to control the track more easily.

According to the invention, the recesses may have a circular cross-section. This embodiment is particularly advantageous, as the recesses may be made by drilling and an optimum centering or positioning of the coacting protruding portion of the slide member is obtained.

Moreover, according to the invention, the slide members may be shaped as rotation-symmetrical bodies with two diametrally opposite, lateral indentations forming therebetween the portion of the shaft adapted to extend through the slot of the groove, each being formed essentially corresponding to the adjacent edge portion of the mast, thus forming the slot of the groove. As a result, the slide members are prevented from rotating, as their indentations coact with the edge portions forming the slot of the groove. The size of the slide members is thereby minimised and the same slide member may be used for various sizes and types of grooves, if said grooves are shaped in such manner in the slot area that the portion of the slide member formed by the indentations may be inserted into the slot and at the same time prevents the slide members from rotating.

Furthermore, according to the invention, the protruding end portion of the slide members may be conically tapered towards its outer end. This embodiment is advantageous for engaging the recess in the track.

Moreover, according to the invention, the track may be an essentially T-shaped, hollow profile, the cavity thereof being adapted and dimensioned to receive the outermost end portion of the slide members. This embodiment provides a saving in materials due to the use of a hollow profile and further machining of the recesses is reduced, as portions thereof are formed by the cavity of the profile.

Further, according to the invention, the transverse openings in the track may be provided with countersunk holes for the heads of the screws opposite the recesses for the shaft of the slide members, when the fastening means are screws.

According to the invention, in this connection the screws may advantageously have countersunk heads.

BRIEF DESCRIPTION OF THE DRAWINGS

The invention is described in greater detail below with reference to a particularly preferred embodiment and accompanying drawings, in which.

DETAILED DESCRIPTION OF PREFERRED EMBODIMENTS

Figure 1:
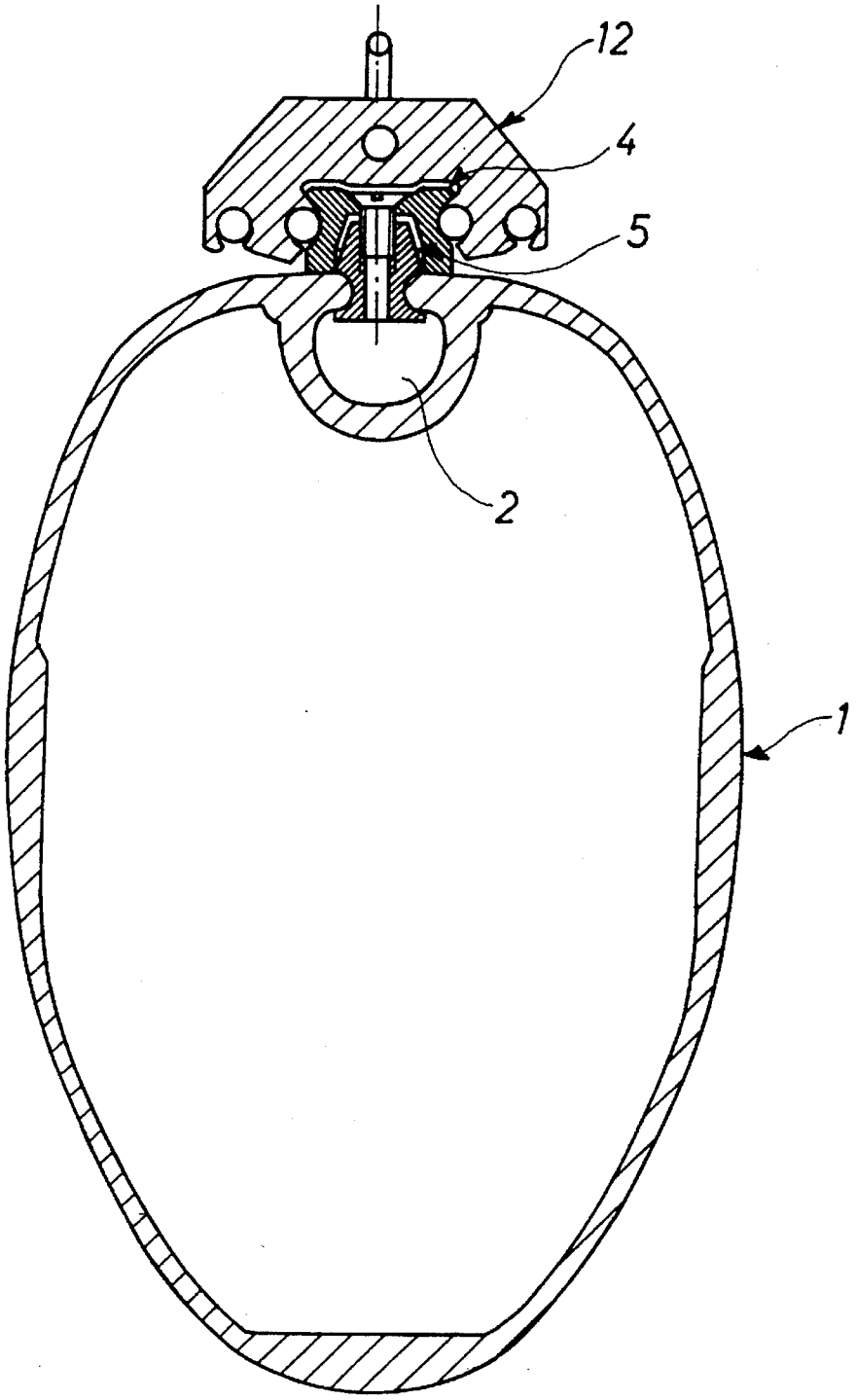
FIG. 1 is a cross-sectional view through a preferred embodiment of a track system according to the invention mounted on a mast, a car being arranged on the track.
Figure 2:
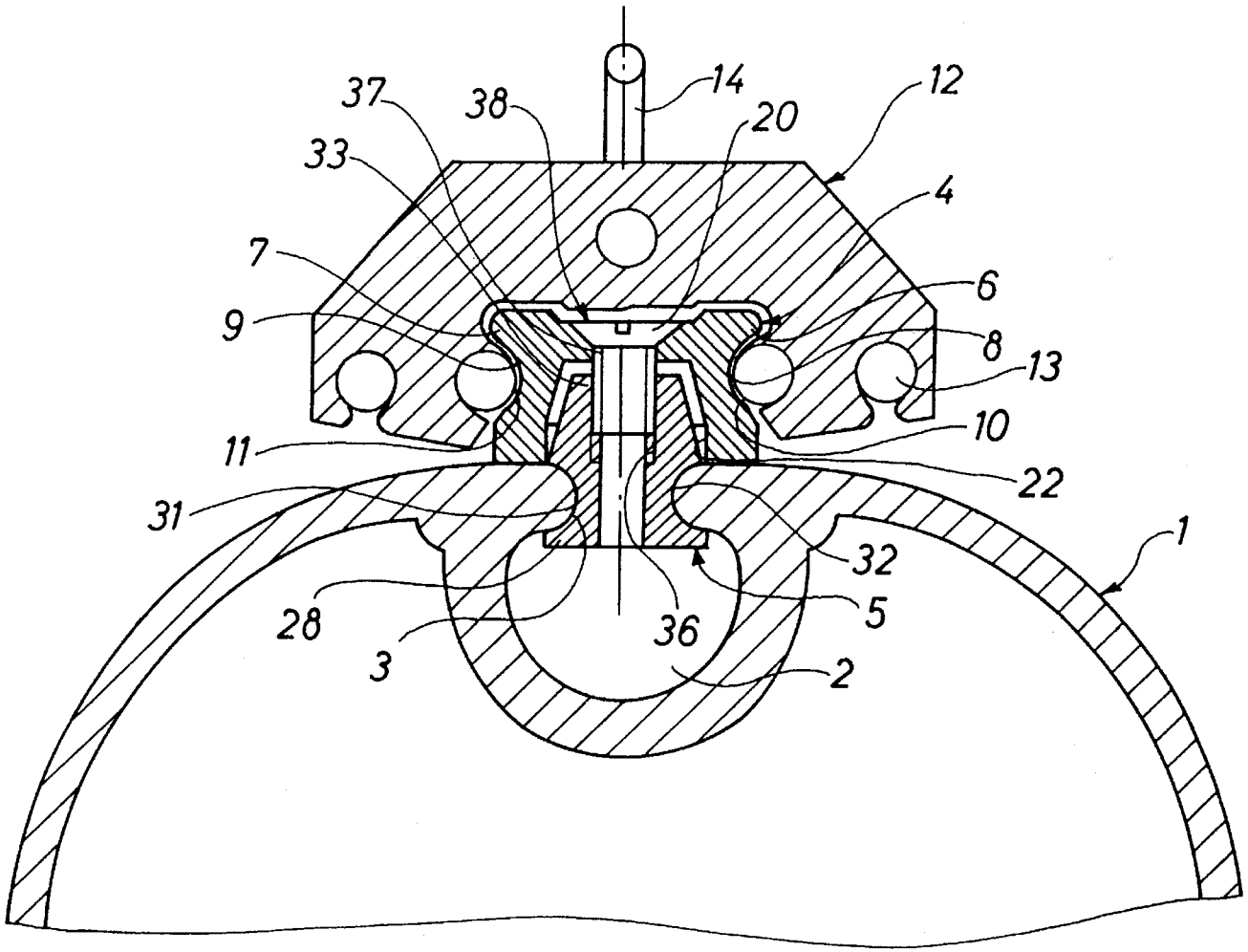
FIG. 2 is a fraction of FIG. 1 in larger scale.
Figure 3:
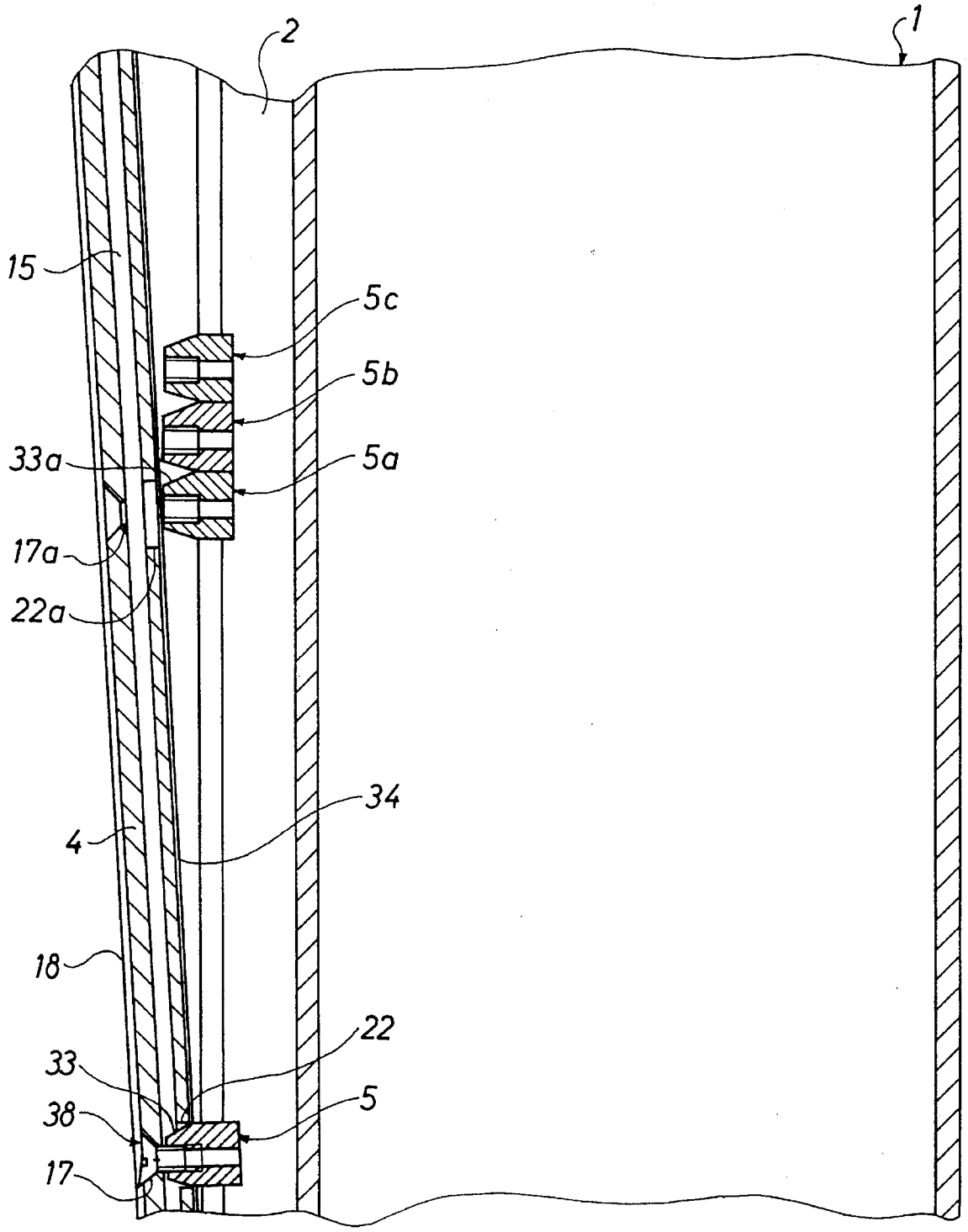
FIG. 3 is a longitudinal sectional view through the mast shown in FIGS. 1 and 2 illustrating of the mounting of the track system according to the invention.

The mast 1 shown in FIG. 1 to 3 has a groove 2 with a slot or slit 3.

The track system according to the invention, adapted to be fastened onto the mast 1 at the groove 2, comprises a track 4 and a plurality of slide members 5.

Figure 4:
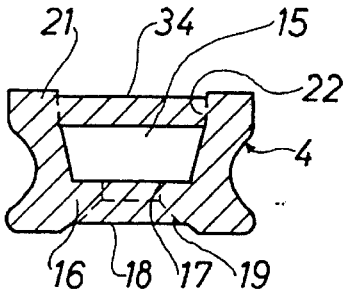
FIG. 4 is a cross-sectional view through a track of the track system according to the invention.
Figure 5:
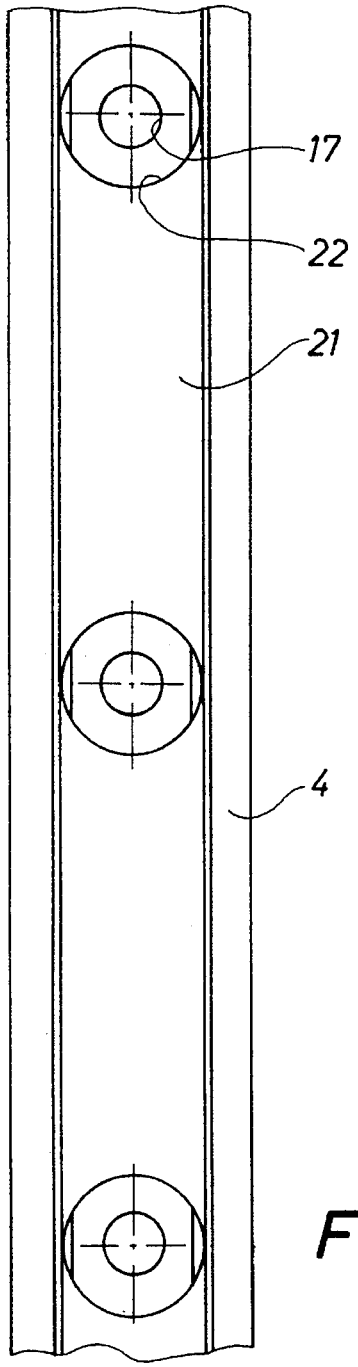
FIG. 5 is plan view of the track seen from below, that is from the side facing the mast.
Figure 6:
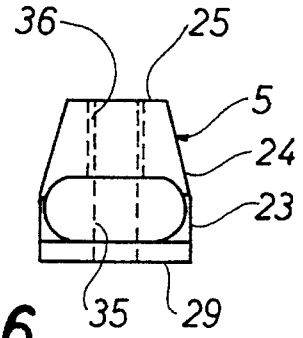
FIG. 6 is a side view of a slide member of the track system according to the invention.
Figure 7:
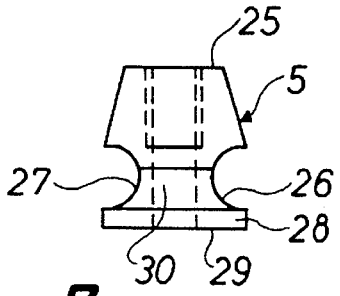
FIG. 7 is a front view of the slide member of FIG. 6.
Figure 8:
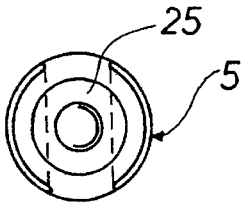
FIG. 8 is a top view of the slide member of FIG. 6

As it is evident from FIG. 2 and 4, the track 4 is essentially T-shaped and has in a cross-sectional view protruding arms 6, 7, opposite guide faces 8,9 being formed on the lower surface thereof. Corresponding guide faces 10, 11 on a car 12 coact with said guide faces on the track 4 to ensure an axial sliding of the car along the track. In the embodiment shown, the guide faces of the car 12 are the surfaces of the balls 13, which in a conventional manner lie in ball races. On the side of the car 12 facing away from the mast a mounting 14 extends outwardly. The mounting 14 is adapted to connect the car with the luff of the mainsail (not shown). A plurality of cars are connected with the luff of the mainsail in a manner known per se for retaining said luff to the mast.

The track, preferably made by extruded or anodized aluminium, is a hollow profile having an interior, longitudinal cavity 15, being rhombic in a sectional view. The upper wall 16 of the track is provided with a plurality of through-going transverse openings 17. At the upper face 18 of the track the transverse openings are provided with a countersunk hole 19 for receiving a screw head 20. Coaxially with the transverse openings 17, a plurality of recesses 22 are provided in the lower wall 21 of the track extending to the cavity 15. Preferably, the diameter of the recesses 22 corresponds essentially to the width of the cavity 15 at the bottom thereof.

The track 4 is retained to the mast 1 by means of the slide members 5 being essentially rotation-symmetrical bodies with a lower or interior cylindrical portion 23 and an outer or upper conical portion 24 tapering towards the upper end 25 of the slide member. In the cylindrical portion 23 two diametrally opposite, lateral indentations 26,27 are provided having a semicircular shape and extending slightly into the conical portion 24. The opposite indentations 26, 27 form a base 28 on the slide member adjacent its interior end 29 and a narrowed portion shaped in such a manner that the portion of slide member 5 formed by the indentations 26, 27 may be inserted in the slot 3 of the groove 2 and slid therein and, at the same time, preventing the slide member from rotating. In the preferred embodiment shown, each of the indentations 26, 27 are formed essentially corresponding to the adjacent edge portion 31, 32 of the mast 1.

The shaft 33 of the slide members 5 protruding from the groove 2 or the slot 3 thereof, in the embodiment shown such shaft being formed by the conical portion 24, has a largest diameter which is smaller than the diameter of the recesses 22 in the track 4. Moreover, the protruding portion 33 has a protruding length which is shorter than the total depth of the recesses, that is including the height of the cavity 15 measured from the lower face 34 of the track 4. As a result, said protruding shaft 33 may be received in its entirety in said whole recess in the track 4.

The slide members 5 are further provided with an axially through-going opening 35 being provided with a thread 36 in the area of the outer end 25. The thread 36 is adapted to engage a corresponding thread 37 on a screw 38 inserted through a transverse opening 17 in the track 4 and the head 20 thereof being adapted to be received in a countersunk manner in the countersunk hole 19. The screw head is preferably a countersunk head. With reference to FIG. 3, the track system according to the invention is mounted on an upright mast 1 in the following manner.

First, the number of slide members 5 corresponding to the number of transverse openings 17 in the track 4 is arranged in the groove 2 of the mast 1. A screw 38 is inserted through the lowermost transverse opening 17 in the track 4 for engagement with the inner thread 36 in the lower slide member 5, the protruding shaft 33 of the slide member at the same time being brought into engagement with the recess or hole 22 in the lower wall 21 of the track 4. The screw 38 is loosely fastened in such a manner that the track 4 is slightly inclined in relation to the mast. The line of slide members **5*a*, 5*b*, 5*c* is then moved upwardly by inserting a suitable tool, for instance a screwdriver in between the track 4 and the mast 1, the track at the same time being slightly preloaded towards the mast. The preload may for instance be provided by pressing lightly against the track 4 or by tightening the lowermost screw 38. When the lowermost slide member has been moved upwardly to be in alignment with the second lowermost recess or hole 22*a*, said recess is brought into circumscribing engagement with the outermost portion of the protruding shaft 33*a*, and the second lowermost slide member 5*a* is thereby retained in the track 4 in such a manner that it may be engaged by a screw inserted through the second lowermost transverse opening 17*a***.

However, it is not necessary to screw said screw in the second lowermost transverse opening, as it is possible to continue to move the third lowermost slide member **5*b*** upwards as described above, until it engages the third lowermost recess or hole. After four to eight slide members are engaged in the manner described, a screw may be screwed into the uppermost thereof.

When a slide member has been brought into engagement with each of the openings in the track 4 by means of the procedure described above, screws are screwed into the corresponding slide members through the remaining transverse openings, in which screws have not been inserted previously. All screws are subsequently tightened for fastening of the track 4 to the mast 1.

The invention may be altered in many ways without thereby deviating from the scope of thereof. The fastening means, adapted to be received in the transverse openings and to coact with the axial openings in the slide members, may be a pop rivet. In this connection the head of the pop rivet may likewise advantageously be countersunk in a countersunk hole in the upper or outwardly facing wall of the track 4.

I claim:

1. A track system for being fastened to a groove of a spar, the system comprising:

a profiled track configured to receive cars in an axially slidable manner, the track including a plurality of transverse openings for receiving fasteners;

a plurality of slide members adapted to be slidably and non-rotatably arranged in the groove of a spar, each slide member having a base which engages an interior of the groove of a spar upon attachment of said slide members in the groove, and a shaft which extends through a slot which opens into the groove of a spar upon attachment of the slide members to the spar, the shaft of each slide member having an axial opening which coacts with a fastener passing through a corresponding transverse opening in the track for fastening the track to the plurality of slide members; and wherein the track is provided with a plurality of recesses corresponding to said plurality of transverse openings in the track, each of said recesses being disposed opposite to a corresponding transverse opening, wherein a protruding portion of the shaft of a slide member is positionable in one of the recesses of the track with the axial opening in said shaft in substantial alignment with a corresponding transverse opening.

2. A track system according to claim 1, wherein the recesses in the track have a circular cross-section.

3. A track system according to claim 1, wherein the slide members are shaped as rotation-symmetrical bodies with two diametrally opposite, lateral indentations which form therebetween a portion of the shaft which extends through the slot which opens into the groove of a spar upon attachment of the slide members to the spar.

4. A track system according to claim 3, wherein the protruding portion of each slide member is conically tapered away from the base of the slide member.

5. A track system according to claim 4, wherein the track is a substantially T-shaped hollow member with an interior cavity configured to receive the protruding portion of each slide member.

6. A track system according to claim 1, wherein the protruding portion of each slide member is cortically tapered away from the base of the slide member.

7. A track system according to claim 1, wherein the track is a substantially T-shaped hollow member with an interior cavity configured to receive the protruding portion of each slide member.

8. A track system according to claim 1, further comprising screws for fastening the track to the plurality of slide members by passing the screws through the axial opening of each slide member and a corresponding transverse opening in the track.

9. A track system according to claim 8, wherein the transverse openings in the track include a countersunk portion for receiving head portions of the screws such that the head portions are substantially flush with an outer surface of the track.

* * * * *